US005341511A

United States Patent [19]

Wells

[11] Patent Number: 5,341,511

[45] Date of Patent: Aug. 30, 1994

[54] ARTICULAR SKELETON, INSECT PROTECTIVE GARMENT

[76] Inventor: Marvin H. Wells, 5265 Daffodil Dr., Fredericksburg, Va. 22407

[21] Appl. No.: 43,005

[22] Filed: Apr. 5, 1993

[51] Int. Cl.[5] ..... A41D 13/00

[52] U.S. Cl. ..... 2/2; 2/1; 2/69; 2/243.1

[58] Field of Search ..... 2/2, 1, 4, 69, DIG. 1, 2/258, DIG. 3, 243.1, 255, 79, 84, 227, 108

[56] References Cited

U.S. PATENT DOCUMENTS

| | | | |
|---|---|---|---|
| 499,965 | 6/1893 | Bushnell . | |
| 640,412 | 1/1900 | Petersen . | |
| 1,203,155 | 10/1916 | Strout . | |
| 2,344,811 | 3/1944 | Gill | 2/2 |
| 3,783,451 | 1/1974 | Malin | 2/DIG. 1 X |
| 4,395,781 | 8/1983 | Myers . | |
| 4,685,152 | 8/1987 | Heare . | |
| 4,716,594 | 1/1988 | Shannon . | |
| 5,214,797 | 6/1993 | Tisdale | 2/DIG. 1 X |
| 5,249,307 | 10/1993 | Lemoine | 2/84 |

*Primary Examiner*—Clifford D. Crowder

*Assistant Examiner*—Gloria Hale

*Attorney, Agent, or Firm*—Kurt G. Hammerle; Raymond L. Greene

[57] ABSTRACT

A garment for protecting a person against bites from insects uses a fabric of fine mesh for hindering the entry of small insects and an inner skeleton for supporting the fabric of fine mesh. The fine mesh includes a plurality of outer edges and elastic material. The elastic material connects to a different outer edge. The elastic material allows the fine mesh to fit snugly over the inner skeleton. The elastic material also constricts any openings around the neck, wrists, waist, and ankles of the wearer. The inner skeleton comprises a group of supporting bands, each band comprising a group of poly-filled spacers and a group of second spacers connected to the poly-filled spacers. Each band encircles and surrounds a particular area of the garment wearer's body. Each band also connects to a contiguous supporting band by stretchable material attached to the second spacers and by a poly-filled spacer on one side. The poly-filled spacers contain a coil tubing to support the inner skeleton and accommodate movement of the wearer's body.

19 Claims, 6 Drawing Sheets

ARTICULAR SKELETON, INSECT PROTECTIVE GARMENT

BACKGROUND OF THE INVENTION

1. Field of the Invention

The present invention relates generally to articles of clothing and more specifically to a garment for protection against small insects.

2. Description of the Related Art

During the seasons of warm climate, mosquitoes and other biting or stinging insects hinder the enjoyment of open air activities by hunters, hikers, joggers, and other outdoor enthusiasts. Attempts to diminish or lessen the proximity of such insects include various chemicals and protective clothing. The chemicals available to tackle the insect problem are often in the form of a spray or liquid. These chemicals are relatively effective but have disadvantages including adverse environmental effects and also adverse health or allergic effects on the consumer, especially during extended use.

Protective clothing, on the other hand, includes garments which have a fine mesh fabric for screening mosquitoes from the wearer's skin. Various devices, such as buttons, springs, spacers made of rope, plastic or cloth tufts, inflatable tubes, or plastic inserts, space the fine mesh fabric away from the skin of the wearer to prevent an insect from reaching through the mesh and contacting the skin. For example, the prior art in U.S. Pat. No. 3,783,451 by Malin discloses an insect-protective garment comprising an insect netting coupled to skin separating members such as circular rings, elongated ribs, or inflatable tubes for spacing the netting away from the wearer's skin. This garment provides only a single airflow pattern (i.e., through the net to the wearer's skin). Another example is U.S. Pat. No. 4,716,594 by Shannon, which provides a protective garment comprising a plurality of fabric components secured together by stitching seams. The fabric components comprise inner and outer layers. The outer layer prevents the passage of mosquitoes, while the inner layer is thick enough to space the outer layer at a distance from the skin of the wearer which is greater than the spanning reach of a mosquito's stinger. These prior art devices are particularly uncomfortable to wear in warm climates because their inner spacing members have a large surface area which bears directly on the wearer's skin and thereby limits circulation of air. Further, these devices are also uncomfortable to wear in sport and hunting activities because their design restricts against normal movement of the human body.

SUMMARY OF THE INVENTION

An object of the present invention is to protect against small insects with a garment which precludes a small insect from reaching the skin of the garment's wearer.

Another object is to facilitate mobility of a protective garment against small insects.

Yet another object is to protect against small insects with a garment for wear during hot or warm weather.

A further object is to protect against small insects with a garment which is compactible and easily stored.

The present invention attains the foregoing and additional objects by providing a garment for protection against small insects. The garment comprises an outer fabric of fine mesh for hindering the entry of small insects and an inner skeleton providing shape, articulation and spacing from the wearer's skin. The outer mesh and inner skeleton combine to form either a shirt or a pair of trousers.

In accordance with one aspect of the invention, the fine mesh fabric has a plurality of outer edges, each edge having elastic material. The elastic material allows the fabric to fit snugly over the skeleton and constricts openings around the neck, wrists, waist, and ankles of the wearer.

In accordance with another aspect of the invention, the inner skeleton comprises a group of horizontal supporting bands, each band comprising a plurality of poly-filled spacers and a second plurality of second spacers connected to the poly-filled spacers. Each band encircles and surrounds a particular area of the body. Each band also connects vertically to a contiguous supporting band by stretchable material attached to the second spacers and by a poly-filled spacer on one side.

In accordance with yet another aspect of the invention, the poly-filled spacers contain a coil tubing to support the inner skeleton and accommodate movement of the human body. Preferably, each second spacer is made of inflatable material with hollow openings which connect to the coil tubing of the poly-filled spacers. An inlet tube located at the end of one of the poly-filled spacers enables the wearer to inflate the entire inner skeleton simply by blowing air into the inlet tube. The coil tubing of the poly-filled spacer transports the air to the hollow openings of the second spacers. Accordingly, the supporting bands expand and support the fine mesh fabric. Alternatively, each second spacer is non-inflatable material preformed to a particular thickness to space the fabric of fine mesh from the skin of the wearer.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF THE INVENTION

Figure 1:
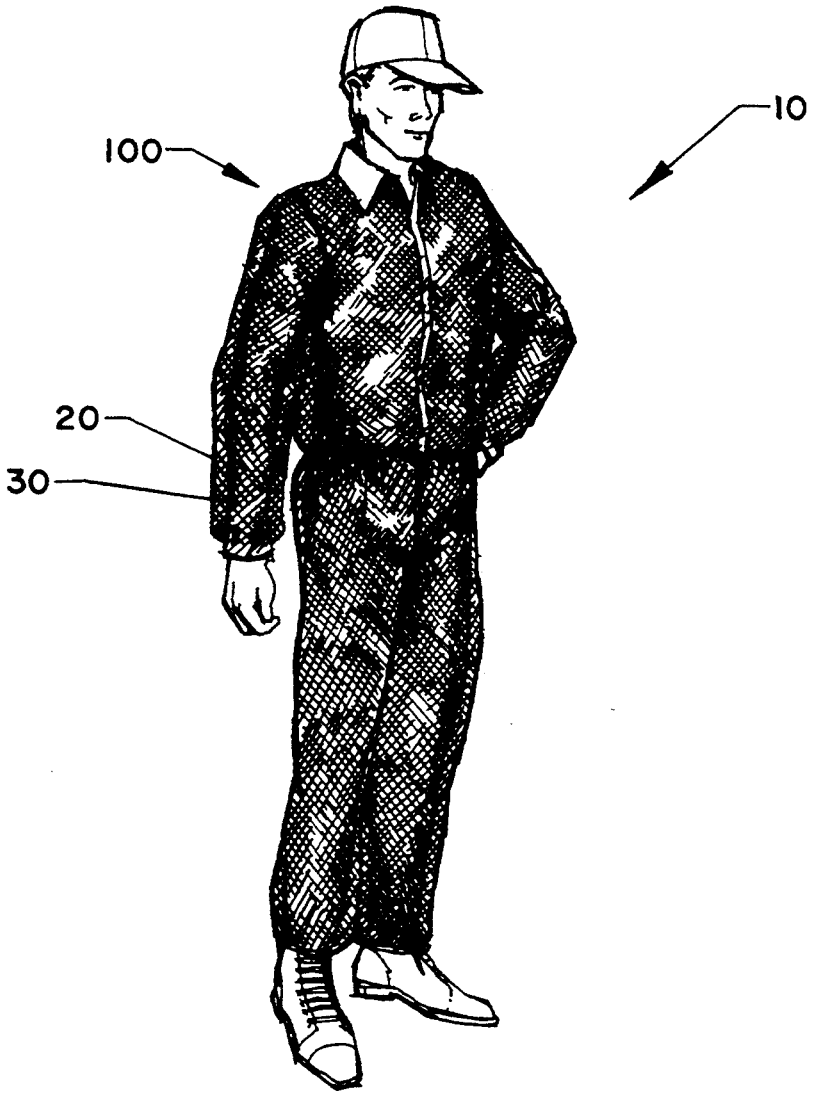
FIG. 1 is a perspective view of person wearing an embodiment of the present invention.

Referring now to FIG. 1, a flexible, comfortable garment for protecting against bites from small insects, designated generally as 10, is shown on a wearer 100. The protective garment has two major functional components—a means for screening small insects or outer mesh 20 and a means for supporting the means for screening or inner skeleton 30.

Figure 2B:
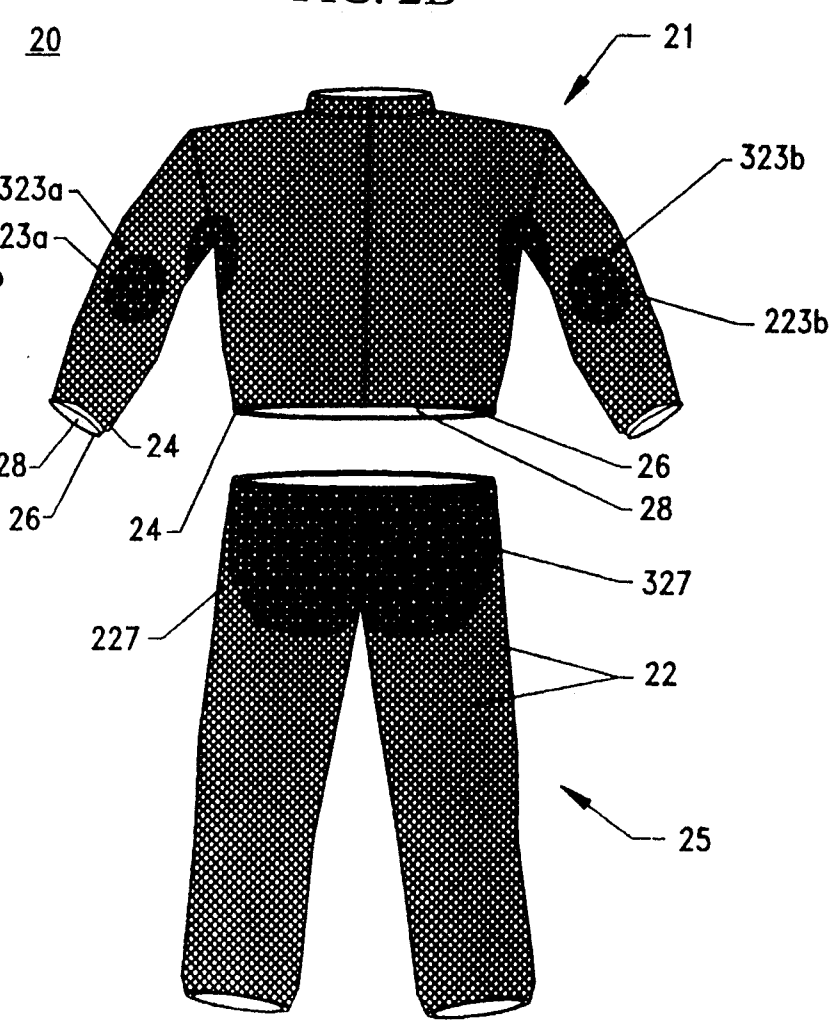
FIG. 2B is a rear view of the fabric of fine mesh in the pattern of a shirt and a pair of trousers.
Figure 2A:
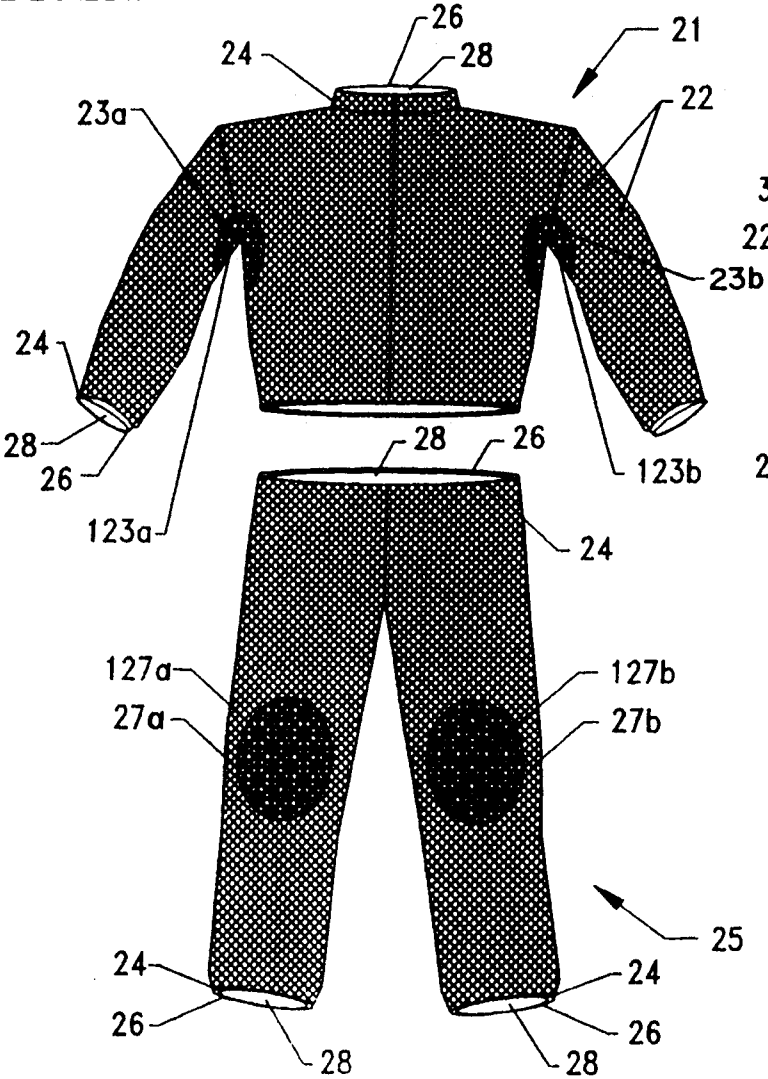
FIG. 2A is a front view of a fabric of fine mesh of the present invention in the pattern of a shirt and of a pair of trousers.

FIGS. 2A and 2B illustrate front and rear views of the outer mesh 20 in the pattern of a shirt 21 and a pair of trousers 25. The outer mesh 20 is a fabric having a plurality of small openings 22 for hindering entry of small insects and for providing breathability by providing a path of air circulation perpendicular to the wearer's skin. The outer mesh 20 has a plurality of outer edges 24 and a plurality of elastic means 26. Each elastic means 26 connects to a different outer edge 24, and, as a result, the outer mesh 20 fits snugly over the inner skeleton. The elastic means 26 also constricts any openings 28 around the neck, wrists, waist, and ankles of the wearer.

In accordance with one aspect of the invention, FIGS. 2A and 2B demonstrate that the outer mesh 20 further comprises patches of protective fabric. Referring to FIG. 2A, the shirt 21 has a pair of patches 23*a* and 23*b* attached to outer mesh 20 at armpit areas 123*a* and 123*b*. Additionally, the trousers 25 have a pair of patches 27*a* and 27*b* attached to the outer mesh 20 at different knee areas 127*a* and 127*b*. Referring now to FIG. 2B, the shirt 21 has a second pair of patches 223*a* and 223*b* which attach to the outer mesh 20 at different elbow areas 323*a* and 323*b*, respectively. The trousers 25 also have a second patch 227 which attaches at the rear seat area 327 of the trousers. The patches provide protection against elements of the outdoors at locations having the greatest wear and tear and thereby add to the durability of the garment.

Figure 3:
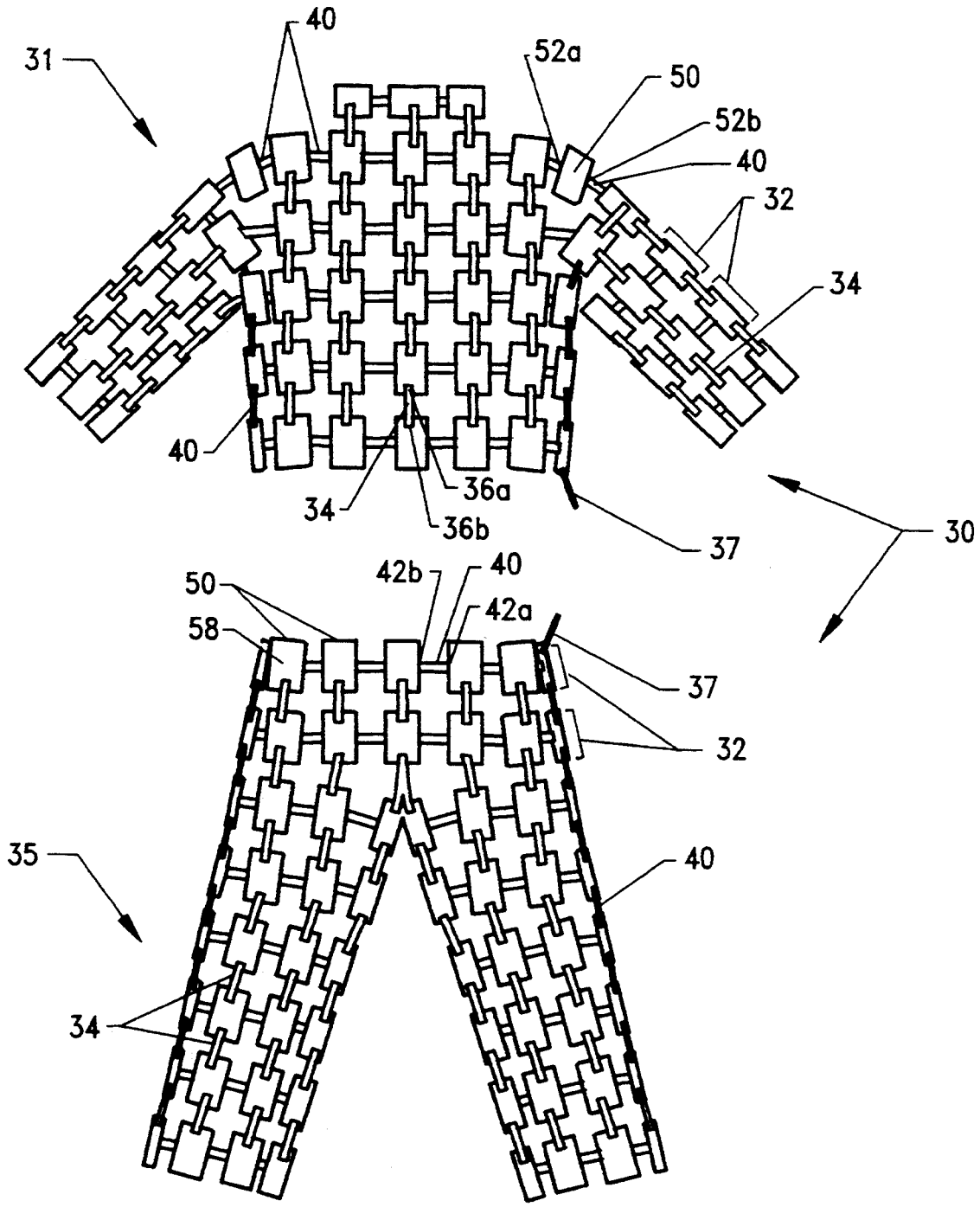
FIG. 3 is a front view of an embodiment of an inner skeleton of the present invention.

As shown in FIG. 3, the inner skeleton 30 comprises a group of horizontal supporting bands 32, each band comprising a group of first spacers 40 and a group of second spacers 50. Each first spacer 40 connects at opposite ends 42*a* and 42*b* to a different second spacer 50. Similarly, each second spacer 50 connects at its opposite ends 52*a* and 52*b* to a different first spacer 40. Both spacers have a cloth facing (not shown) on their inner surfaces for comfort. The second spacer 50 also has a cloth facing 58 on its outer surface.

Each band 32 encircles and surrounds in essentially a horizontal manner a particular area of the garment wearer's body. FIG. 3 illustrates only a front view of the bands 32 which comprise the inner skeleton. A rear view, however, would appear identical. The group of bands 32 combine to form an inner skeleton having the pattern of a shirt 31 or the pattern of a pair of trousers 35. Each band 32 connects to a contiguous horizontal band 32 by stretchable material 34 and by a first spacer 40 on one side. The stretchable material 34 attaches at one end 36*a* to a second spacer 50 and at its other end 36*b* to a different second spacer 50.

Figure 4:
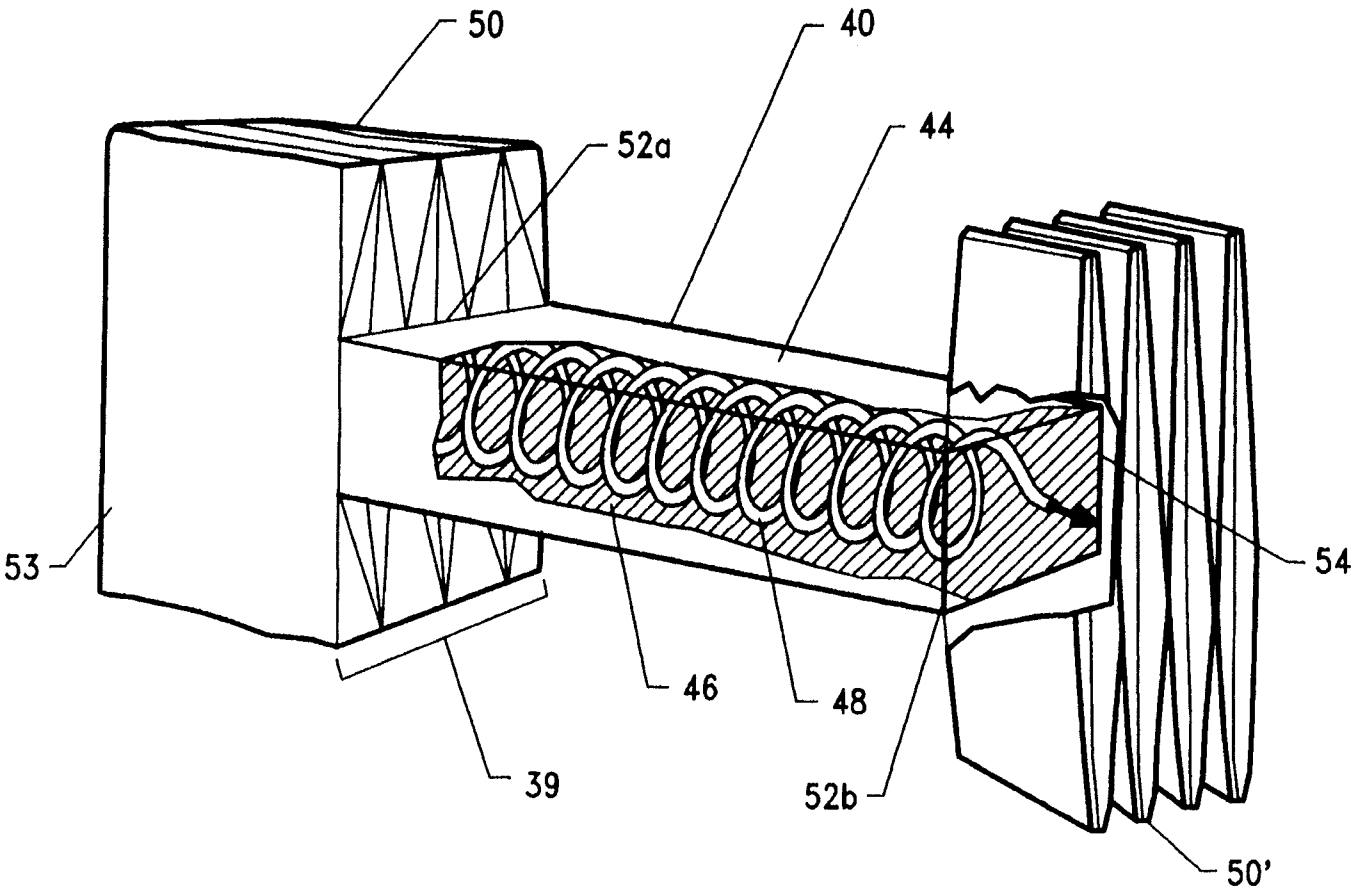
FIG. 4 is a perspective view of an embodiment of a first spacer and a second spacer of the present invention.

In accordance with another aspect of the invention, FIG. 4 details construction of the first spacer 40 and the second spacer 50. Each first spacer 40 comprises a bag 44 containing poly-fill 46 which surrounds a coiled tubing 48. The poly-fill 46 is lightweight material and serves as a spacer and as a cushion. The tubing 48 is hollow to enable the transport of air and also serves as a flexible spacer and cushion.

Each second spacer 50 is a bag made of inflatable, hermetic material 53 such as plastic or rubber, and has a hollow opening 54. The hollow opening 54 receives at each end 52*a* and 52*b* of the second spacer the ends of the coiled tubing 48.

Referring now to FIGS. 3 and 4, two inlet tubes 37, each connected to the end of one of the poly-filled spacers 40, enables the wearer to inflate the inner skeleton 30 of the shirt 31 and the trousers 35 simply by blowing air into the tube. The coiled tubing 48 of the first spacer 40 transports the air to the hollow openings 54 of the second spacer, which expands to a thickness 39. FIG. 4 illustrates an inflated second spacer 50 and a deflated second spacer 50'. The deflated second spacer 50' will also expand to the thickness 39 upon receipt of air or another gaseous substance. Inflation of all the second spacers gives an inner skeleton 30 which supports the outer mesh of the garment.

Figure 5:
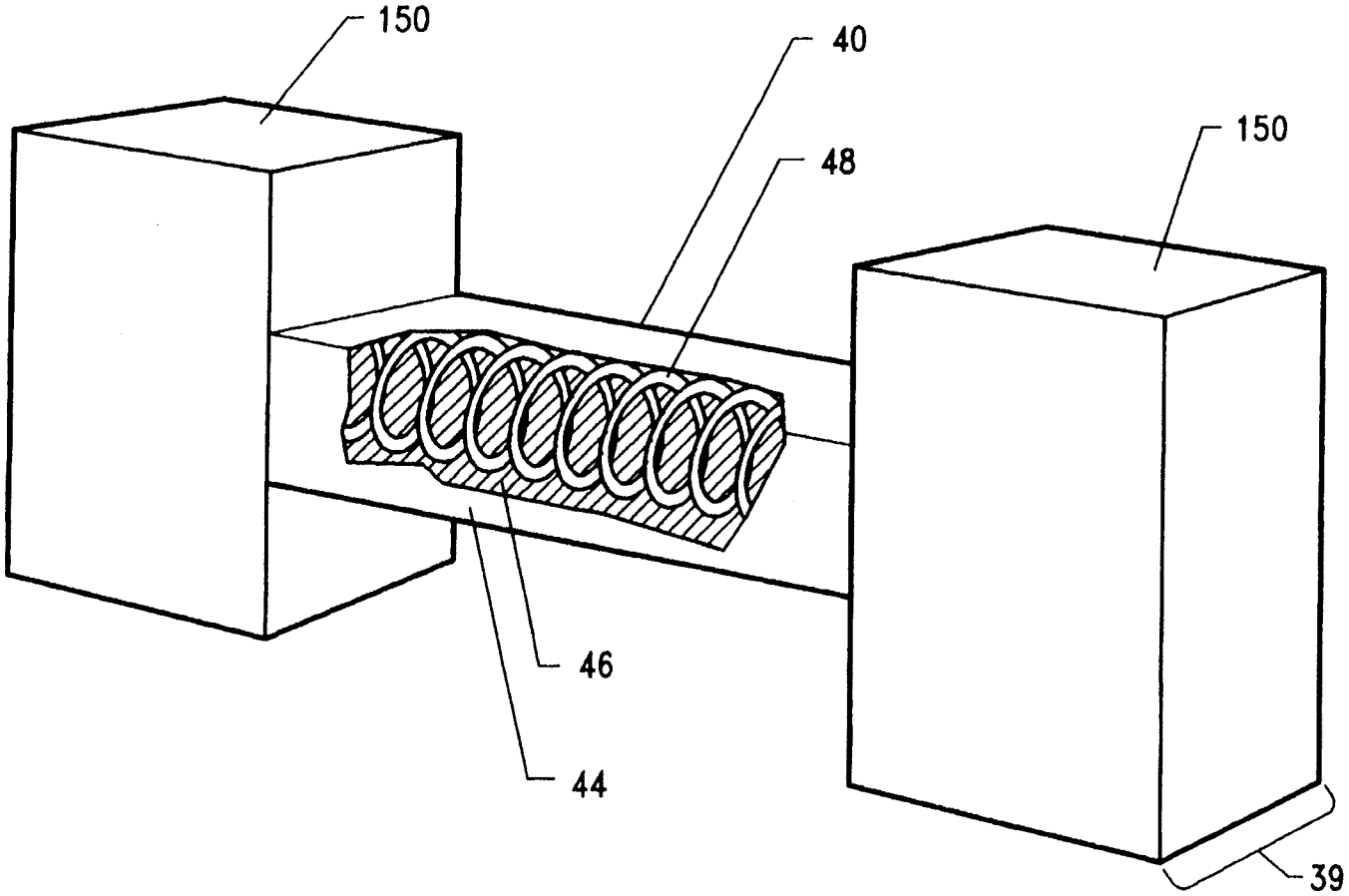
FIG. 5 is a perspective view of an alternative embodiment of a first spacer and a second spacer of the present invention.

Alternatively, FIG. 5 illustrates a first spacer 40 and a non-inflatable second spacer 150. In this embodiment, the first spacer 40 comprises a bag 44 containing poly-fill 46 which surrounds a coil 48. The second spacer 150 is made of non-inflatable material such as foam rubber having a thickness 39.

Figure 6:
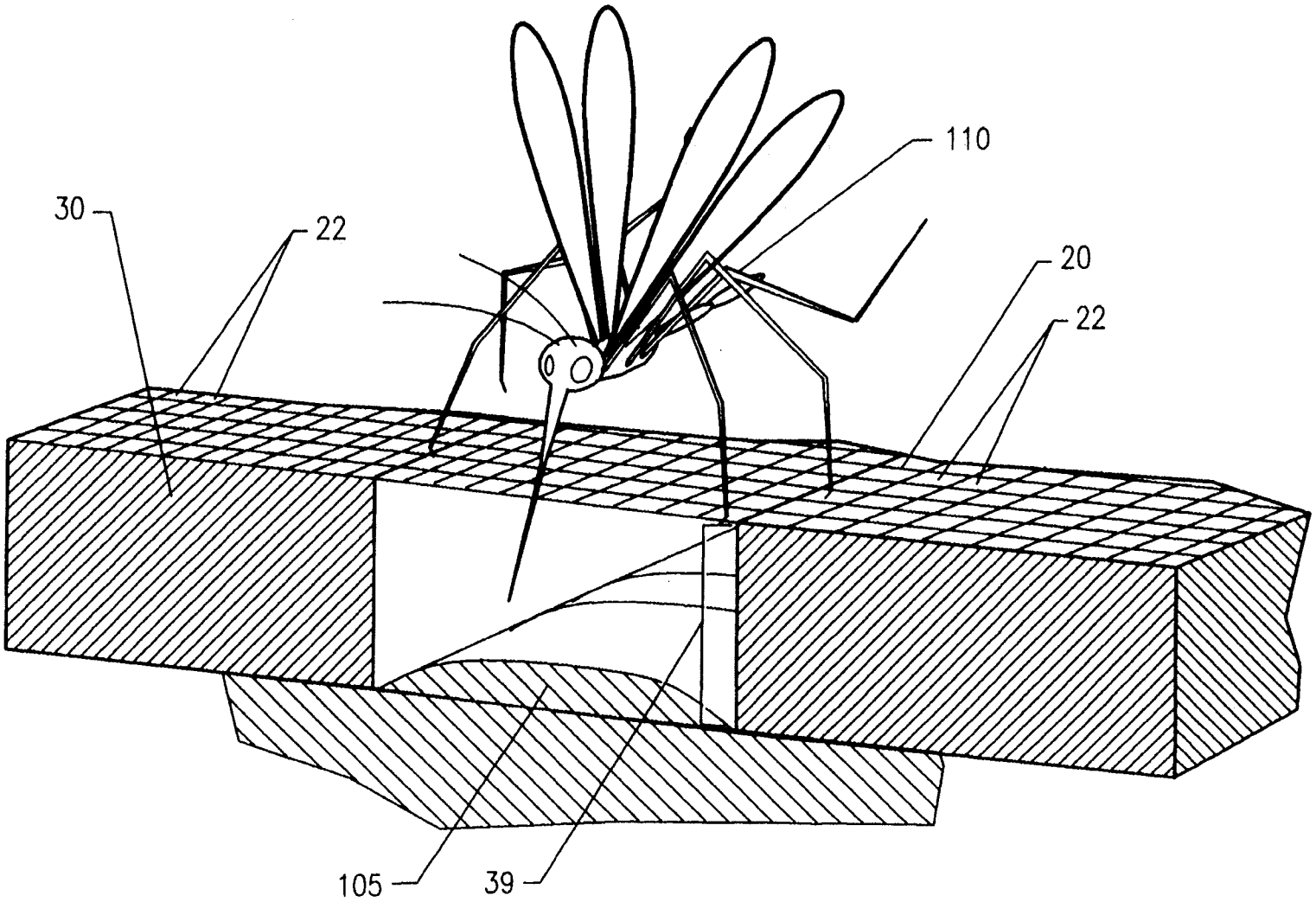
FIG. 6 illustrates the inability of a mosquito to bite the skin of a wearer through the protective garment.

FIG. 6 illustrates how the garment of the present invention protects the wearer from insect bites. A small insect 110, such as a mosquito, lands on the outer mesh 20, but the openings 22 of the mesh are so small as to prevent the insect's entry of the garment. The insect 110 then attempts to bite from the outside of the outer mesh, but its efforts are unsuccessful because the thickness 39 of the inner skeleton 30 is at such a distance that the stinger of the insect is incapable of reaching the skin 105.

The stretchable material which connects the contiguous bands of spacers provides comfort by increasing the flexibility of the garment and by reducing the surface area of the inner skeleton which bears directly against the wearer's skin. The stretchable material also enables airflow within the garment circumferentially about the wearer's skin and thereby enhances breathability. As a result, the wearer may engage in physical activities without overheating, despite the warm temperatures which normally co-exist with large numbers of small, biting insects.

The garment is also comfortable to wear because the plurality of supporting bands facilitate rotational and translational movement of the wearer. As a result, the wearer has a garment that accommodates his movement as he runs down the street at night or as he crouches to hide in the bushes while hunting.

The coiled tubing helps space the outer mesh away from the body of the wearer and adds to the overall flexibility of the garment by bending and flexing easily to match the wearer's movements. The coiled tubing also provides a supportive structure and transports air throughout the inner skeleton when inflatable second spacers are used.

The novel features of the present invention include an inner skeleton having a group of supporting bands with two types of spacers, a spacer of the inner skeleton having a coil in its structure, and stretchable material connecting each supporting band of the inner skeleton. The advantages of the present invention include protection against small insect bites and enhanced flexibility and breathability of the insect protective garment.

Other advantages include compact storage of the inflatable embodiment of the invention.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A garment for protecting a wearer against bites from small insects, comprising:

an outer means for screening small insects; and an inner means, positioned under said means for screening, for supporting said means for screening said means for supporting forming a grid pattern comprised of a plurality of bands comprised of two types of spacers wherein each first spacer includes a coil and each second spacer is connected on each end to a different first spacer in an alternating manner and wherein each band is connected to a contiguous band by stretchable means.

2. A garment for protecting a wearer against bites from small insects as recited in claim 1, wherein said means for screening small insects further comprises:

a fabric of fine mesh for hindering entry of small insects and for providing breathability to the garment, said fabric of fine mesh having a plurality of outer edges; and a plurality of elastic means, each elastic means connected to a different outer edge of said fabric of fine mesh, for snugly fitting said fabric over said means for supporting and for constricting any openings around the neck, wrists, waist, and ankles of the wearer.

3. A garment for protecting a wearer against bites from small insects as recited in claim 2, wherein said fabric of fine mesh is formed into a long-sleeved shirt.

4. A garment for protecting a wearer against bites from small insects as recited in claim 2, wherein said fabric of fine mesh is formed into a pair of trousers.

5. A garment for protecting a wearer against bites from small insects as recited in claim 3, wherein said means for screening small insects further comprises two patches of protective fabric, each patch of protective fabric being attached to the fabric of fine mesh at a different elbow area of the shirt.

6. A garment for protecting a wearer against bites from small insects as recited in claim 3, wherein said means for screening small insects further comprises two patches of protective fabric, each patch of protective fabric being attached to the fabric of fine mesh at a different armpit area of the shirt.

7. A garment for protecting a wearer against bites from small insects as recited in claim 4, wherein said means for screening small insects further comprises two patches of protective fabric, each patch of protective fabric being attached to the fabric of fine mesh at a different knee area of the trousers.

8. A garment for protecting a wearer against bites from small insects as recited in claim 4, wherein said means for screening small insects further comprises a patch of protective fabric attached to the fabric of fine mesh at the rear seat area of the trousers.

9. A garment for protecting a wearer against bites from small insects as recited in claim 1, wherein each first spacer includes a bag of poly-fill fiber for surrounding each coil.

10. A garment for protecting a wearer against bites from small insects as recited in claim 1 wherein each coil of each first spacer is coiled tubing.

11. A garment for protecting a wearer against bites from small insects as recited in claim 1 wherein each second spacer is made of non-inflatable material.

12. A garment for protecting a wearer against bites from small insects as recited in claim 1 wherein each second spacer is made of inflatable material.

13. A garment for protecting a wearer against bites from small insects as recited in claim 12 wherein each second spacer is made of hermetic material.

14. A garment for protecting a wearer against bites from small insects as recited in claim 12 wherein each second spacer has a hollow opening which receives the coiled tubing and expands upon the entry of a gaseous substance.

15. A garment for protecting a wearer against bites from small insects as recited in claim 1, wherein the second spacer has a thickness such that an insect which is able to slip its head through said means for screening would be incapable of reaching and biting the skin of the wearer.

16. A garment for protecting a wearer against bites from small insects as recited in claim 12, wherein the inflatable material is made of plastic.

17. A garment for protecting a wearer against bites from small insects as recited in claim 12, wherein the inflatable material is made of rubber.

18. A garment for protecting a wearer against bites from small insects as recited in claim 1, wherein said means for screening is formed into a long-sleeved shirt.

19. A garment for protecting a wearer against bites from small insects as recited in claim 1, wherein said means for supporting is formed into a pair of trousers.

* * * * *